US006769961B1

(12) United States Patent
Kistler et al.

(10) Patent No.: US 6,769,961 B1
(45) Date of Patent: Aug. 3, 2004

(54) CHEMICAL MECHANICAL PLANARIZATION (CMP) APPARATUS

(75) Inventors: Rodney C. Kistler, Los Gatos, CA (US); Aleksander Owczarz, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/345,694

(22) Filed: Jan. 15, 2003

(51) Int. Cl.[7] ..... B24B 49/00; B24B 31/00; B24B 19/00

(52) U.S. Cl. ..... 451/8; 451/36; 451/53; 451/63; 451/7; 451/104; 451/106; 451/113

(58) Field of Search ..... 451/41, 285, 287, 451/7, 6, 8, 10, 11, 36, 53, 54, 59, 63, 104, 106, 113

(56) References Cited

U.S. PATENT DOCUMENTS 5,679,212 A * 10/1997 Kato et al. ..... 156/636.1
5,755,614 A * 5/1998 Adams et al. ..... 451/60
6,171,467 B1 * 1/2001 Weihs et al. ..... 205/93
6,280,289 B1 * 8/2001 Wiswesser et al. ..... 451/6
6,315,635 B1 * 11/2001 Lin ..... 451/7
6,341,998 B1 * 1/2002 Zhang ..... 451/41
6,454,819 B1 * 9/2002 Yano et al. ..... 51/298
6,575,820 B2 * 6/2003 Liu et al. ..... 451/443
6,582,281 B2 * 6/2003 Doan et al. ..... 451/41
6,613,200 B2 * 9/2003 Li et al. ..... 204/198

* cited by examiner

*Primary Examiner*—Eileen P. Morgan
(74) *Attorney, Agent, or Firm*—Martine & Penilla, LLP

(57) ABSTRACT

A chemical mechanical planarization (CMP) apparatus includes a bath of an aqueous solution. A first holder, which is configured to support a wafer, is disposed within the bath. A first spindle is configured to rotate the first holder. A second holder, which is rotated by a second spindle, is disposed above the first holder. The second holder supports a planarization media, which is disposed within the bath. The planarization media is oriented to face the surface of the first holder on which the wafer is to be supported. The planarization media can be a pad containing polyurethane or a substrate having an overlying abrasive film. The CMP apparatus also can include a system for recirculating and reconditioning the aqueous solution. A method for performing a CMP process also is described.

37 Claims, 11 Drawing Sheets

201
Substrate
203
Abrasive Film
Substrate
201
205
Substrate
201
203
200
Provide Substrate
202
Abrasive Film Deposited
204
Abrasive Film Patterned

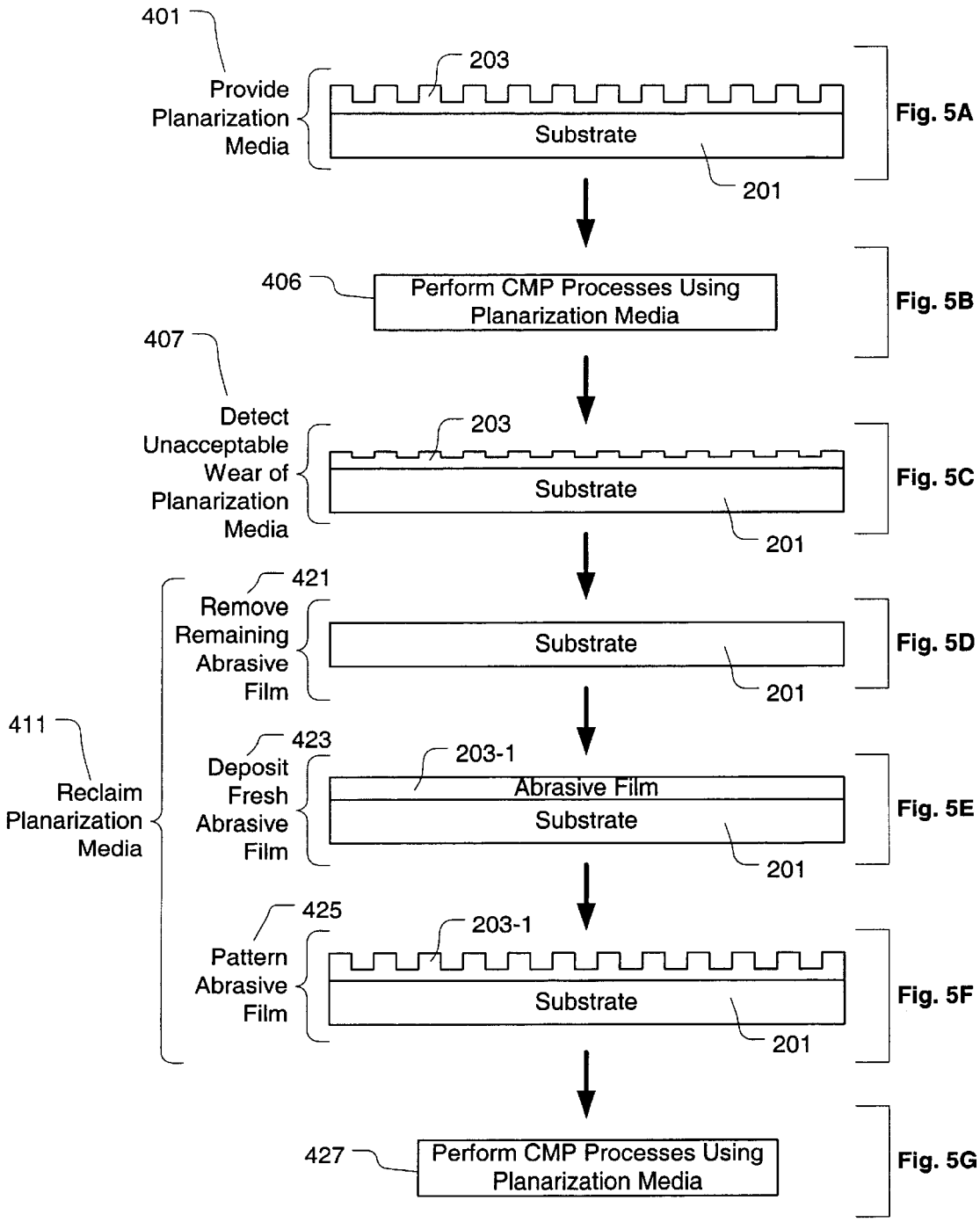
401
Provide Planarization Media
203
Substrate
201
Fig. 5A
406
Perform CMP Processes Using Planarization Media
Fig. 5B
407
Detect Unacceptable Wear of Planarization Media
203
Substrate
201
Fig. 5C
411
Reclaim Planarization Media
421
Remove Remaining Abrasive Film
Substrate
201
Fig. 5D
423
Deposit Fresh Abrasive Film
203-1
Abrasive Film
Substrate
201
Fig. 5E
425
Pattern Abrasive Film
203-1
Substrate
201
Fig. 5F
427
Perform CMP Processes Using Planarization Media
Fig. 5G

CHEMICAL MECHANICAL PLANARIZATION (CMP) APPARATUS

CROSS REFERENCE TO RELATED APPLICATIONS

This application is related to U.S. patent application Ser. No. 10/345,658, filed on even date herewith, and entitled "Planarization Media for Chemical Mechanical Planarization (CMP)," and U.S. patent application Ser. No. 10/345,658, filed on even date herewith, and entitled "Electrochemical Assisted CMP." The disclosures of both of these related applications are incorporated herein by reference.

BACKGROUND OF THE INVENTION

The present invention relates generally to semiconductor fabrication and, more particularly, to a chemical mechanical planarization (CMP) apparatus and a method for performing a CMP process.

In the fabrication of semiconductor devices, planarization operations are often performed on a semiconductor wafer ("wafer") to provide polishing, buffing, and cleaning effects. Typically, the wafer includes integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Patterned conductive layers are insulated from other conductive layers by a dielectric material. As more metallization levels and associated dielectric layers are formed, the need to planarize the dielectric material increases. Without planarization, fabrication of additional metallization layers becomes substantially more difficult due to increased variations in a surface topography of the wafer. In other applications, metallization line patterns are formed into the dielectric material, and then metal planarization operations are performed to remove excess metallization.

The CMP process is one method for performing wafer planarization. In general, the CMP process involves holding and contacting a rotating wafer against a moving polishing pad under a controlled pressure. CMP systems typically configure the polishing pad on a rotary table or a linear belt. Additionally, a slurry is used to facilitate and enhance the CMP process. The slurry is introduced and distributed over a working surface of the polishing pad. Distribution of the slurry is generally accomplished by a combination of polishing pad movement, wafer movement, and pressure applied between the wafer and the working surface of the polishing pad.

FIG. 1A is an illustration showing a top view of a conventional rotary-type CMP system 101 implementing a polishing pad 103. The polishing pad 103 rotates in a direction 104. A wafer holder 105 attached to a spindle 107 is configured to rotate in a direction 108 above the polishing pad 103. A slurry manifold 109 is disposed above the polishing pad 103.

FIG. 1B is an illustration showing a side view of the conventional rotary-type CMP system 101. The polishing pad 103 is disposed on top of a rotary table 117. The rotary table 117 is supported by a spindle 119 capable of rotating in the direction 104. A wafer 113 is supported above the polishing pad 103 by the wafer holder 105. The wafer holder 105 is supported by the spindle 107, which rotates in the direction 108. During operation, a force 121 is applied to the spindle to cause the wafer 113 to contact the polishing pad 103. Also during operation, a slurry 115 is dispensed onto the polishing pad 103 from the slurry manifold 109. As the polishing pad 103 rotates in the direction 104, the slurry 115 is transported to the wafer 113.

FIG. 1C is an illustration showing a top view of the conventional rotary-type CMP system 101 in operation. During operation, the polishing pad 103 rotates in the direction 104 while the wafer holder 105 rotates the wafer 113 (see FIG. 1B) in the direction 108. Slurry 115 dispensed from the slurry manifold 109 onto the polishing pad 103 is transported to the wafer 113. Not all of the slurry 115 dispensed onto the polishing pad 103 is capable of traversing beneath the wafer 113. Thus, a slurry buildup 127 occurs at a front edge of the wafer 113. Due to the rotation of wafer 113, the slurry buildup 127 tends to wrap around the wafer 113 and becomes excess slurry 129. As the polishing pad 103 rotates, the excess slurry 129 moves toward and over an outer edge of the polishing pad 103 under the influence of centrifugal force. A similar situation exists in linear-type CMP systems in which excess slurry is thrown from a moving belt pad rotating around a pair of rollers. In general, less than 20% of the slurry 115 that is dispensed traverses beneath the wafer 113. The slurry 115 contribution to a total consumable cost of the CMP process can range from 60% to 80%. Therefore, a need exists to improve the efficiency of slurry utilization in the CMP process.

In addition to inefficient slurry use, maintaining a uniform temperature distribution across the wafer 113 is also a challenge with the rotary-type CMP system 101. As the polishing pad 103 traverses beneath the wafer 113, the polishing pad 103 will be exposed to heat being generated from friction and chemical reactions. As the polishing pad 103 rotates, a lower angular velocity exists at a radius r1 as compared to a radius r2. Thus, a unit surface area of the polishing pad 103 traversing beneath the wafer 113 at the radius r1 will be exposed to more heat than a unit surface area of the polishing pad 103 traversing beneath the wafer 113 at the radius r2. Hence, a temperature variation will develop across the polishing pad 103 from radius r1 to radius r2 as the CMP process continues. A similar situation exists in linear-type CMP systems in which a temperature variation can develop across a linear belt pad. However, in the linear-type CMP system, the temperature variation across the linear belt pad is due to a circular surface area of the wafer 113 that is in contact with the linear belt pad. Basically, outer regions of the linear belt pad traverse below smaller segments of the wafer 113. Thus, outer regions of the linear belt pad are exposed to less heat than inner regions. Hence, a temperature variation will develop across the linear belt pad from an outer region to an inner region as the CMP process continues. Since the CMP process is partially dependent on temperature, having a temperature variation across the rotary-based polishing pad 103 or linear belt pad may adversely affect the CMP process results. Rotation of the wafer 113 and slurry movement can help reduce the temperature variation, but not in a totally effective manner. Therefore, a CMP system is needed in which a more uniform temperature distribution can be maintained across a working surface such as the rotary-based polishing pad or the linear belt pad.

Many conventional CMP pads (i.e., rotary-based pads or linear belt pads) have pores dispersed therein. As a conventional CMP pad is used, inner planes of the conventional CMP pad become exposed, thus exposing the pores. In general, the pores in conventional CMP pads have a mean diameter of about 40 microns ±25 microns (1 micron=1E-6 meter). Many surface feature sizes on a wafer vary from about 0.3 micron to about 20 microns. Hence, the larger pore diameters contained within the conventional CMP pad are not satisfactory to provide ideal planarization. Further, as the pores are not evenly distributed throughout the conventional CMP pad, the surface area contact between the wafer and pad can change as a function of wear, causing uncontrolled variability to be introduced into the CMP process. Additionally, the conventional CMP pad has a root mean square (RMS) surface roughness of about 6 microns, which contributes to non-optimal planarization and surface roughness on the wafer. The RMS surface roughness of the conventional CMP pad also introduces difficulty in obtaining a desired wafer surface planarity as low as 0.01 micron. Thus, there is a need for a CMP pad that does not have large and/or uncontrolled surface properties that limit wafer planarization performance.

In addition to CMP pad surface characteristics, abrasives contained within the slurry (i.e., slurry abrasive) also have an effect on the CMP process. A solgel colloidal abrasive is a common type of slurry abrasive defined by discrete abrasive particles. The solgel colloidal abrasive particles can vary in diameter from 0.04 micron ±0.02 micron to 0.2 micron ±0.1 micron. A fumed aggregate abrasive is another common type of slurry abrasive defined by a string of linked abrasive particles having a typical length of about 0.25 micron ±0.1 micron. Some CMP processes may require that a wafer surface planarity of about 0.02 micron ±0.01 micron be obtained. In these instances, common slurry abrasive sizes such as those identified above can yield non-optimal planarization results. Thus, there is a need for a CMP process that can implement smaller abrasive particle sizes to more easily achieve a desired wafer surface planarity.

In view of the foregoing, there is a need for an apparatus and a method that can be implemented in a CMP process to improve the efficiency of slurry utilization, maintain a more uniform temperature distribution across the working surface to which the wafer is exposed, reduce large surface discrepancies on the working surface to which the wafer is exposed, and implement reduced abrasive particles sizes to achieve the desired wafer surface planarity.

SUMMARY OF THE INVENTION

Broadly speaking, the present invention fills these needs by providing a chemical mechanical planarization (CMP) apparatus including a bath in which the CMP operation is conducted. It should be appreciated that the present invention can be implemented in numerous ways, including as a process, an apparatus, a system, a device, or a method. Several embodiments of the present invention are described below.

In accordance with one aspect of the invention, a CMP apparatus is provided. The CMP apparatus includes a bath of an aqueous solution. A first holder, which is configured to support a wafer, is disposed within the bath. A first spindle is configured to rotate the first holder. A second holder, which is rotated by a second spindle, is disposed above the first holder. The second holder supports a planarization media, which is disposed within the bath. The planarization media is oriented to face the surface of the first holder on which the wafer is to be supported. In one embodiment, the planarization media is a pad containing polyurethane. In another embodiment, the planarization media includes a substrate and an abrasive film overlying the substrate.

In one embodiment, the CMP apparatus further includes a system for recirculating and reconditioning the aqueous solution. In one embodiment, the system for recirculating and reconditioning the aqueous solution includes a chemical component analyzer, an auto-titration device, an auto-filtration device, a heat exchanger, and a pump. In one embodiment, the CMP apparatus further includes a device for monitoring a condition of a wafer to be supported by the first holder. The device can measure a wafer surface characteristic parameter such as, for example, film thickness, optical reflection, or an eddy current.

In accordance with another aspect of the invention, a method for performing a chemical mechanical planarization (CMP) process is provided. In this method, a wafer is immersed in a bath of an aqueous solution. A planarization media, which is oriented parallel to a plane of the surface of the wafer, is brought in compliance with the wafer. A portion of the wafer in compliance with the planarization media is then abraded. In one embodiment, the abrading is effected by rotating the planarization media in compliance with the wafer while holding the wafer in a fixed position. In another embodiment, the abrading is effected by rotating the planarization media in compliance with the wafer while rotating the wafer in an opposite direction relative to a planarization media.

In one embodiment, the method further includes circulating the aqueous solution. In one embodiment, the method further includes monitoring a concentration of the aqueous solution. In one embodiment, the method further includes reconditioning the aqueous solution by adjusting a concentration of the aqueous solution. In one embodiment, the method further includes monitoring a condition of the wafer in compliance with the planarization media.

The advantages of the present invention are numerous. Most notably, the CMP apparatus and the method of the present invention enable superior uniform planarization results to be achieved. The CMP apparatus provides an isothermal environment that significantly reduces temperature variations across the wafer surface and significantly reduces the shear forces exerted onto the wafer surface during the CMP process.

When an engineered planarization media, i.e., a planarization media having an abrasive film, is used, the improved surface property control of the planarization media enables a superior wafer surface planarity to be achieved. The CMP apparatus in conjunction with the engineered planarization media enables damage-free planarization processes involving relatively fragile wafer materials such as copper and low-k dielectric material. Planarization and film removal can now be performed more safely, i.e., without damaging the fragile wafer materials, through the use of the isothermal CMP apparatus and the engineered planarization media, which when combined provide more uniform and controlled friction distribution.

In addition, the CMP apparatus and the method of the present invention increase selectivity and thereby allow a CMP process to be self-stopping. In addition, flexibility in sizing of the planarization media can allow the CMP process to focus on a specific portion of the wafer. The CMP apparatus and the method of the present invention also offer economic advantages. For example, through recirculation and reconditioning, the aqueous solution in the CMP apparatus of the present invention is used more efficiently than conventional slurries are used in conventional CMP systems. Also, the engineered planarization media can be reclaimed to reduce the total consumable cost of the CMP process.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which:

FIGS. 3C-1 and 3C-2 are illustrations showing a top view and a cross-sectional view, respectively, of a planarization media having a plurality of upper planar surfaces separated by a first plurality of recesses and a second plurality of recesses, in accordance with one embodiment of the present invention;

FIGS. 3D-1 and 3D-2 are illustrations showing a planarization media having a plurality of pillars defined within an abrasive film overlying a substrate, in accordance with one embodiment of the present invention;

FIGS. 5A–5G illustrate a method for performing a CMP process, in accordance with one embodiment of the present invention.

DETAILED DESCRIPTION OF THE PREFERRED EMBODIMENTS

Several exemplary embodiments of the invention will now be described in detail with reference to the accompanying drawings. In the following description, numerous specific details are set forth in order to provide a thorough understanding of the present invention. It will be apparent, however, to one skilled in the art that the present invention may be practiced without some or all of these specific details. In other instances, well known process operations have not been described in detail to avoid obscuring the present invention unnecessarily.

Figure 1A:
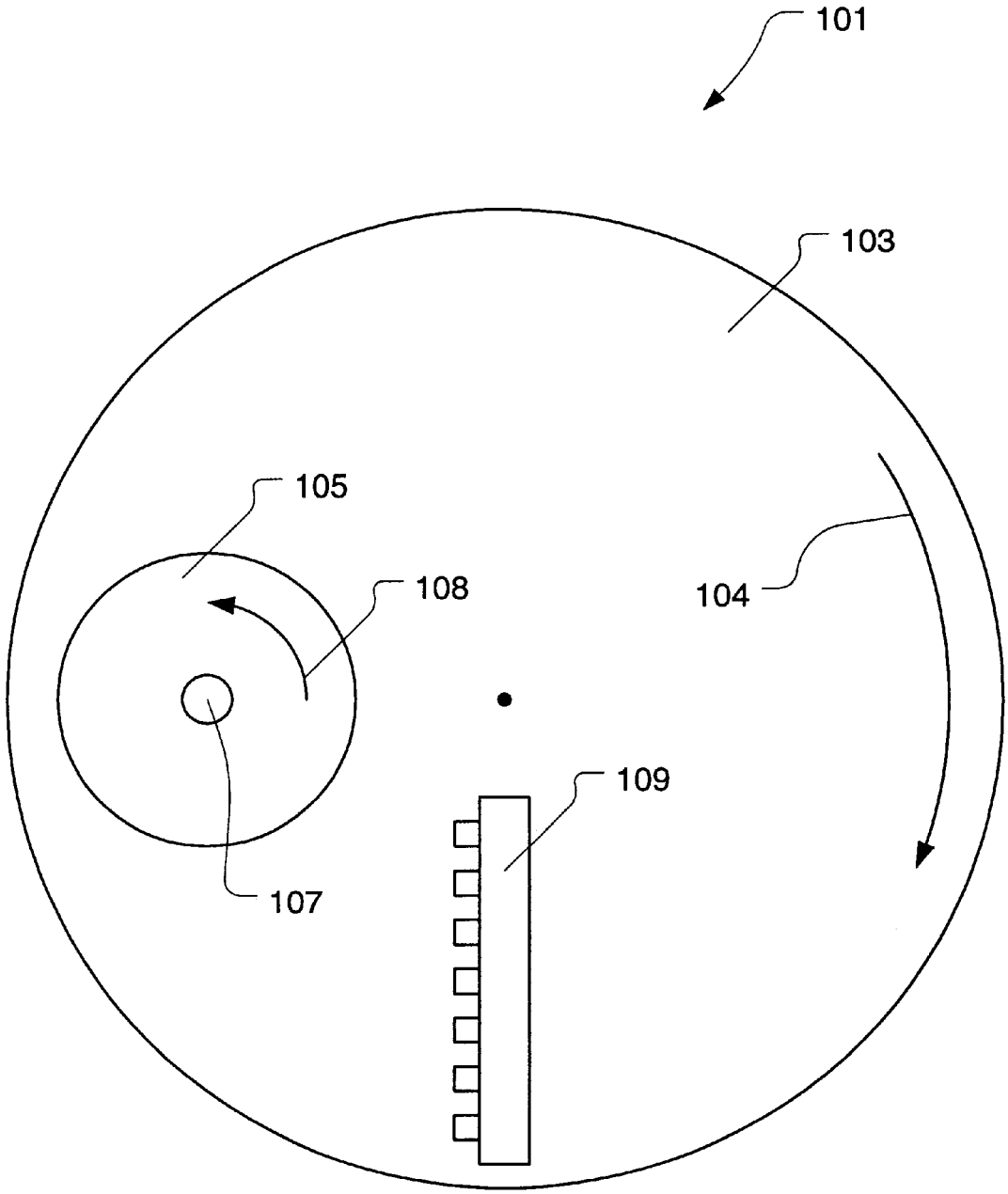
Fig. 1A (Prior Art)
FIG. 1A is an illustration showing a top view of conventional rotary-type CMP system implementing an polishing pad.
Figure 1B:
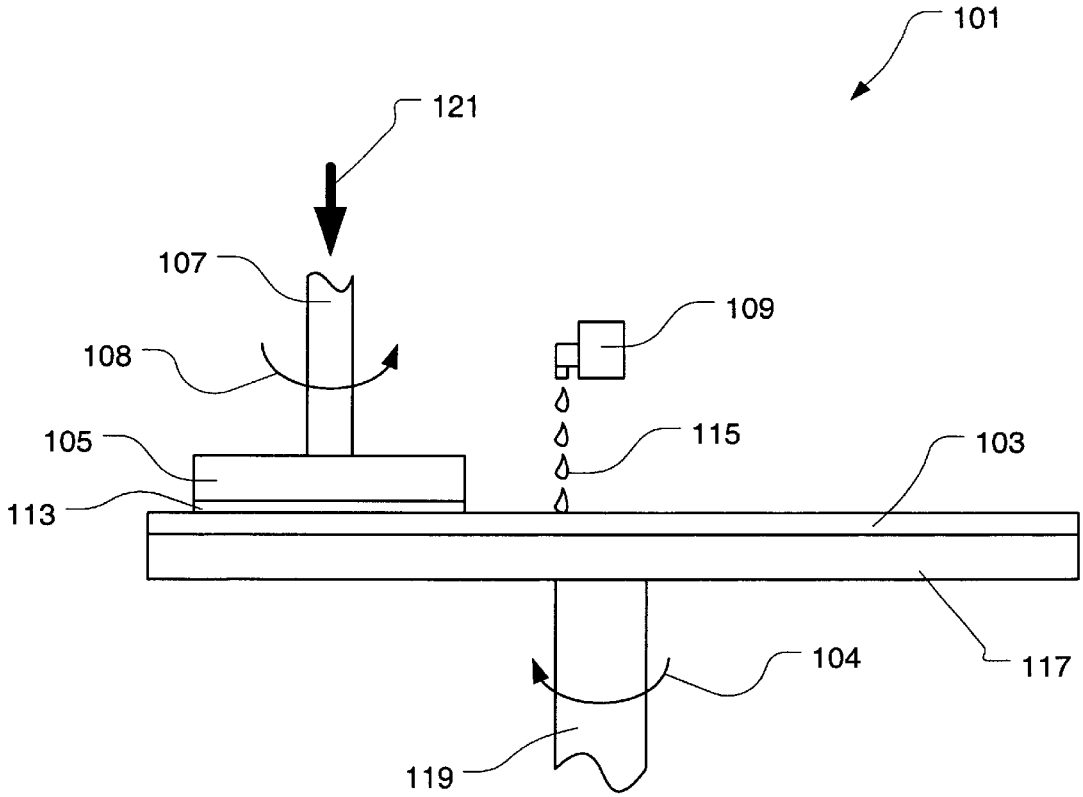
Fig. 1B (Prior Art)
FIG. 1B is an illustration showing a side view of the conventional rotary-type CMP system shown in FIG. 1A.
Figure 1C:
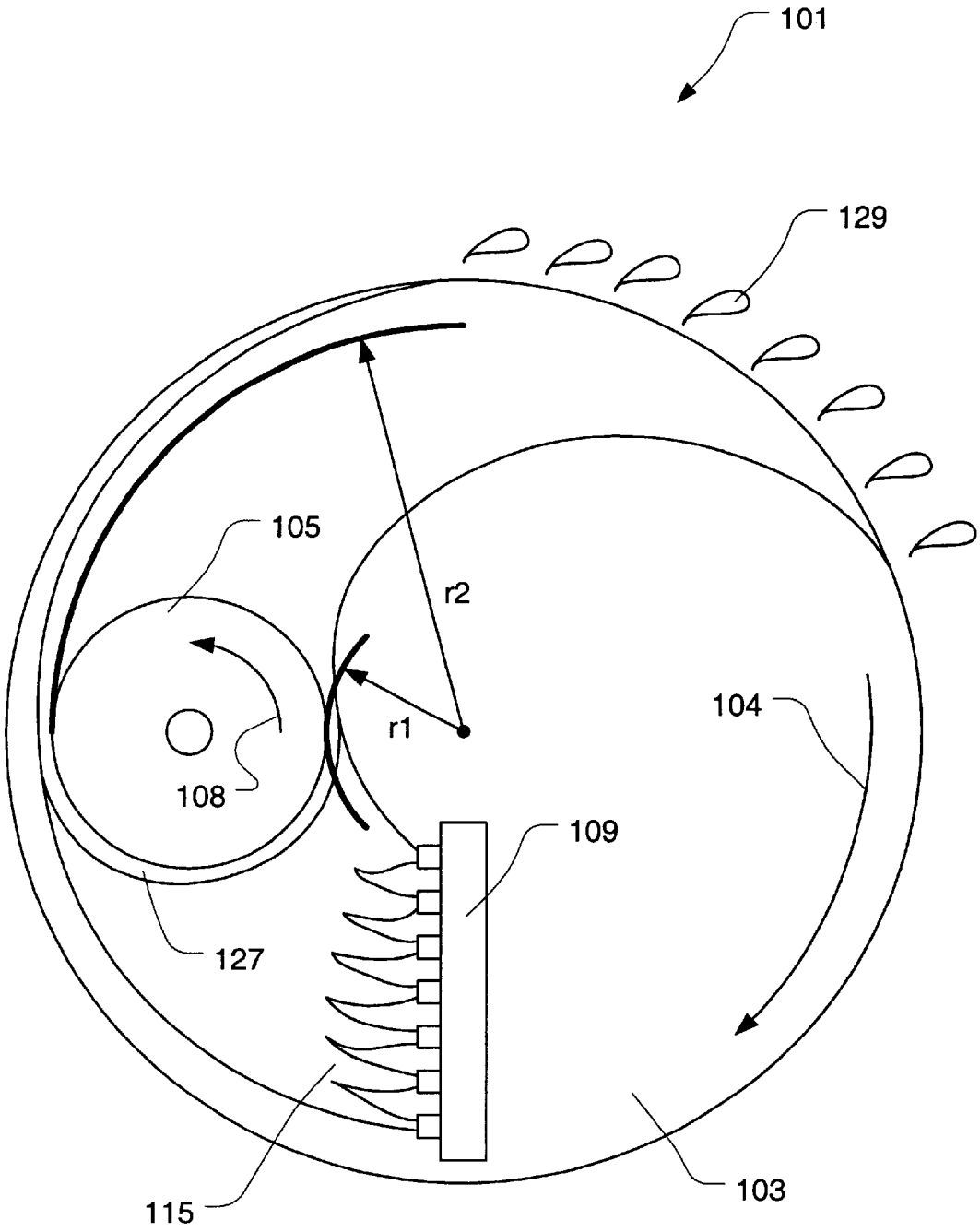
Fig. 1C (Prior Art)
FIG. 1C is an illustration showing a top view of the conventional rotary-type CMP system shown in FIG. 1A in operation.
Figures 2A, 2B, 2C:
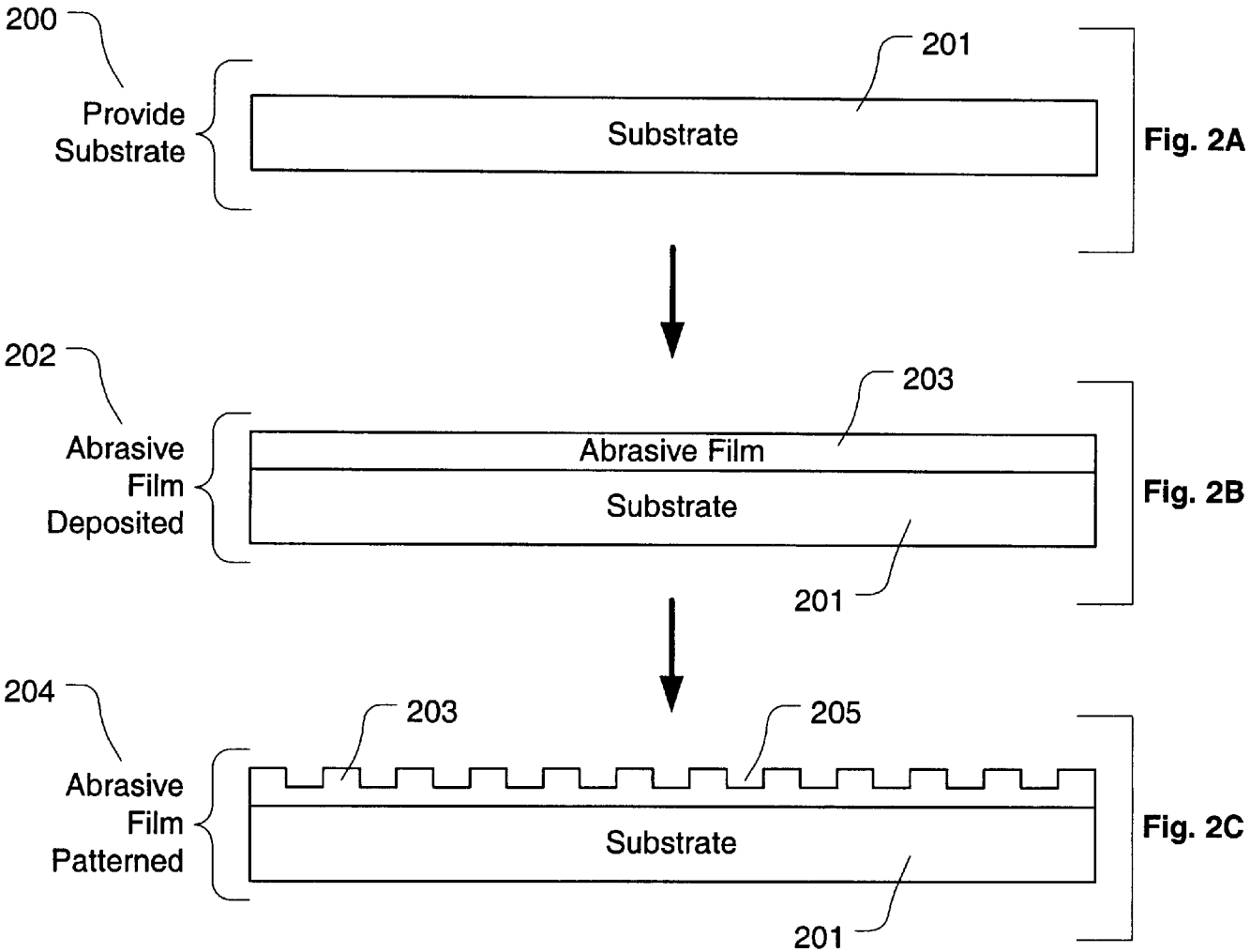
FIGS. 2A–2C illustrate a method for making a planarization media, in accordance with one embodiment of the present invention.

FIGS. 2A–2C illustrate a method for making a planarization media, in accordance with one embodiment of the present invention. A substrate 201 is provided in an operation 200. The substrate 201 can be composed of any suitable material such as, for example, silicon, quartz, ceramic materials, and plastics. An abrasive film 203 is deposited over a surface of the substrate 201 in an operation 202. Semiconductor fabrication methods, e.g., chemical vapor deposition, can be used to deposit the abrasive film 203 over the surface of the substrate 201. The abrasive film 203 may be deposited with a thickness within a range extending from about 0.1 micron (1 micron=1E-6 meter) to about 100 microns. As used herein, the term "about" means within ±10% of a specified value. The abrasive film 203 can be composed solely of an abrasive material or can be composed of mixture containing an abrasive material. The abrasive material can also be composed of one or more abrasive constituents. In one embodiment, the abrasive film 203 is composed of a mixture of two materials, wherein a first material represents from about 50% to about 95% by volume of the mixture, and a second material represents a balance of the mixture. The second material may be the same as the first material with the exception of either a stoichiometric modification or a crystalline structure modification (e.g., modified from an alpha-phase to a gamma-phase). Furthermore, the abrasive film 203 can contain abrasive materials similar to those found in conventional CMP slurries. However, in contrast to conventional CMP processes, the abrasive materials contained in the abrasive film 203 and the method of depositing the abrasive film 203 over the substrate 201 allow a desired wafer surface planarity of 0.02 micron ±0.01 micron to be obtained. Examples of suitable abrasive materials include $SiO_2$, $Si_3N_4$, $Al_2O_3$, SiC, CeO, and polysilicon. It will be apparent to those skilled in the art that ceramic materials other than those mentioned herein also may be used as the abrasive material. The method further includes an operation 204 in which the abrasive film 203 is patterned to create a topography 205. Well-known photolithography techniques can be used to pattern the abrasive film 203 to create the topography 205 in a carefully controlled manner.

From a macroscopic transport perspective, the topography 205 is important for obtaining desired CMP process results. A carefully defined topography 205 will ensure that a uniform chemistry transport is maintained across a wafer surface while the planarization media is in contact with the wafer surface. The design of topography 205 also considers a distribution of force to be applied to the wafer surface during the CMP process. An areal density of topography 205 in contact with the wafer surface will determine the distribution of force applied to the wafer surface. In some cases, the wafer surface may include fragile materials such as Cu or low-k dielectric materials. It is important that the force applied to the wafer surface from the planarization media be distributed such that a stress limit of the fragile materials is not exceeded. Therefore, the areal density of topography 205 in contact with the wafer surface is carefully controlled to optimally distribute the force necessary to perform the CMP process. In general, the topography 205 in contact with the wafer surface is defined by a plurality of upper planar surfaces that are each separated by a plurality of recesses. The plurality of upper planar surfaces occupies a percentage of a total surface area of the substrate within a range extending from about 10% to about 85%. The plurality of upper planar surfaces and the plurality of recesses can be located at controlled intervals across a surface of the underlying substrate 201. Dimensions of the plurality of upper planar surfaces and the plurality of recesses are controlled to carefully define the topography 205, as will be explained in more detail below.

Figures 1, 3A:
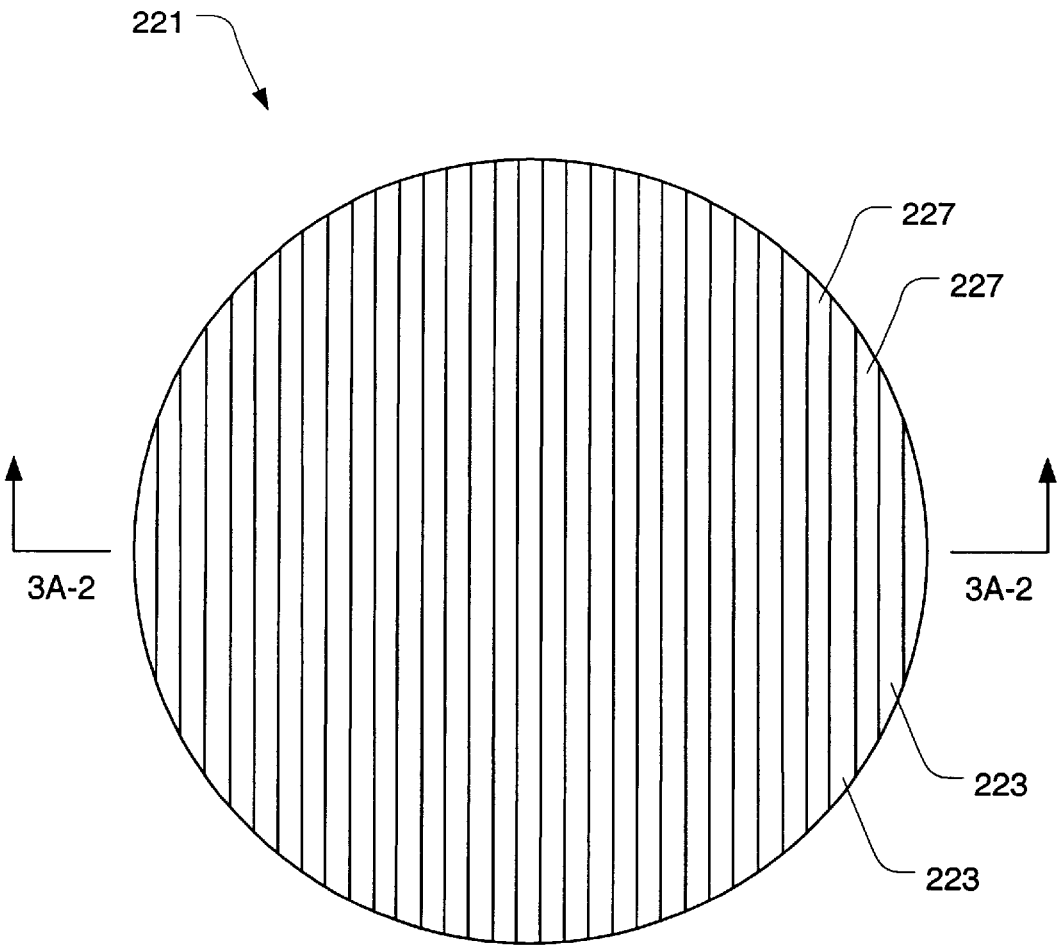
FIGS. 3A-1 and 3A-2 are illustrations showing a top view and a cross-sectional view, respectively, of a planarization media having a plurality of upper planar surfaces separated by a plurality of recesses that traverses the planarization media in a parallel manner, in accordance with one embodiment of the present invention.
Figures 2, 3A:
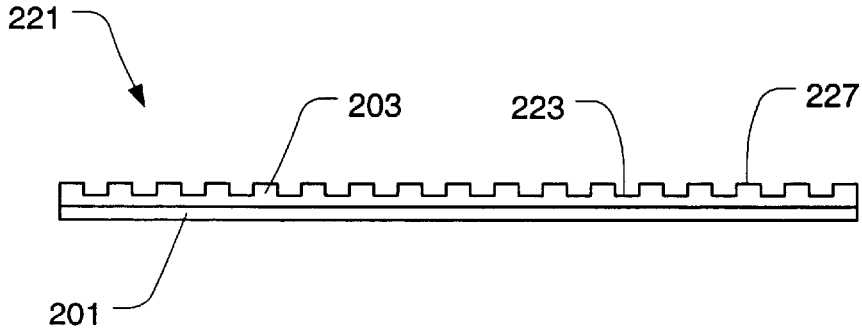

FIGS. 3A-1 and 3A-2 are illustrations showing a top view and a cross-sectional view, respectively, of a planarization media 221 having a plurality of upper planar surfaces 227 separated by a plurality of recesses 223 that traverses the planarization media in a parallel manner, in accordance with one embodiment of the present invention. The plurality of upper planar surfaces 227 and the plurality of recesses 223 are formed within the abrasive film 203 overlying the substrate 201.

Figure 3B:
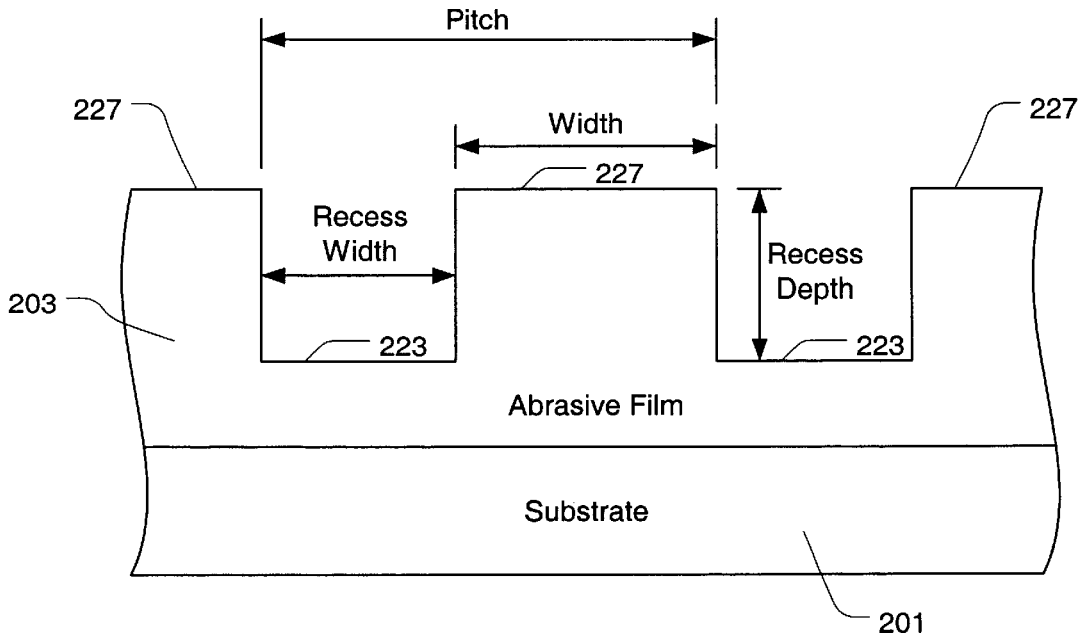
FIG. 3B is an illustration showing a detailed cross-section view of the plurality of upper planar surfaces and the plurality of recesses, in accordance with one embodiment of the present invention.

FIG. 3B is an illustration showing a detailed cross-section view of the plurality of upper planar surfaces 227 and the plurality of recesses 223, in accordance with one embodiment of the present invention. The plurality of upper planar surfaces 227 is defined by a pitch and a width. The plurality of recesses is defined by a recess width and a recess depth. As previously mentioned, the pitch and the width are established such that the plurality of upper planar surfaces 227 covers a percentage of a total surface area of the substrate 201 within a range extending from about 10% to about 85%. Each of the plurality of recesses 223 has a recess width within a range extending from about 1 micron to about 1,000 microns. Also, each of the plurality of recesses 223 has a recess depth within a range extending from about 10 microns to about 500 microns. Furthermore, each of the plurality of upper planar surfaces 227 has a root mean square (RMS) surface roughness within a range extending from about 0.002 micron to about 0.1 micron. Thus, discrepancies across the plurality of upper planar surfaces 227 to which the wafer will be exposed are substantially reduced relative to conventional CMP pads. The aforementioned dimensions associated with the plurality of upper planar surfaces 227 and the plurality of recesses 223 are also applicable to other topographic patterns that can be applied to the planarization media.

Figures 1, 3C:
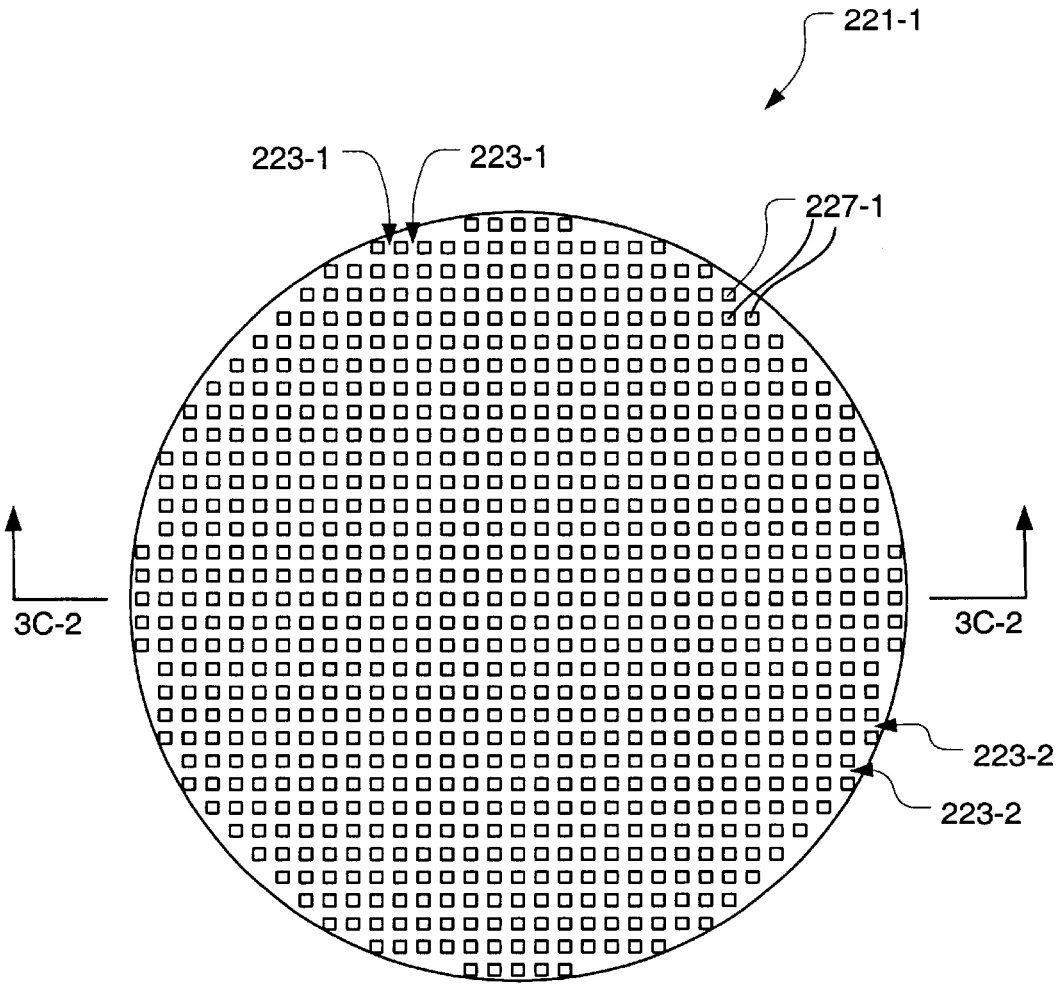
Figures 2, 3C:
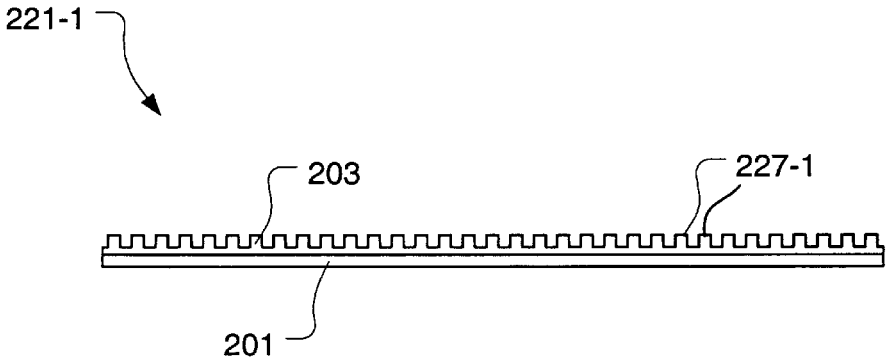

FIGS. 3C-1 and 3C-2 are illustrations showing a top view and cross-sectional view, respectively, of planarization media 221-1 having a plurality of upper planar surfaces 227-1 separated by a first plurality of recesses 223-1 and a second plurality of recesses 223-2, in accordance with one embodiment of the present invention. The first plurality of recesses 223-1 traverses the planarization media in a parallel manner. The second plurality of recesses 223-2 also traverses the planarization media in a parallel manner. However, the second plurality of recesses 223-2 is offset by approximately 90 degrees with respect to the first plurality of recesses 223-1. Each of the plurality of upper planar surfaces 227-1 has a rectangular periphery. The plurality of upper planar surfaces 227-1, the first plurality of recesses 223-1, and the second plurality of recesses 223-2 are formed within the abrasive film 203 overlying the substrate 201.

Figures 1, 3D:
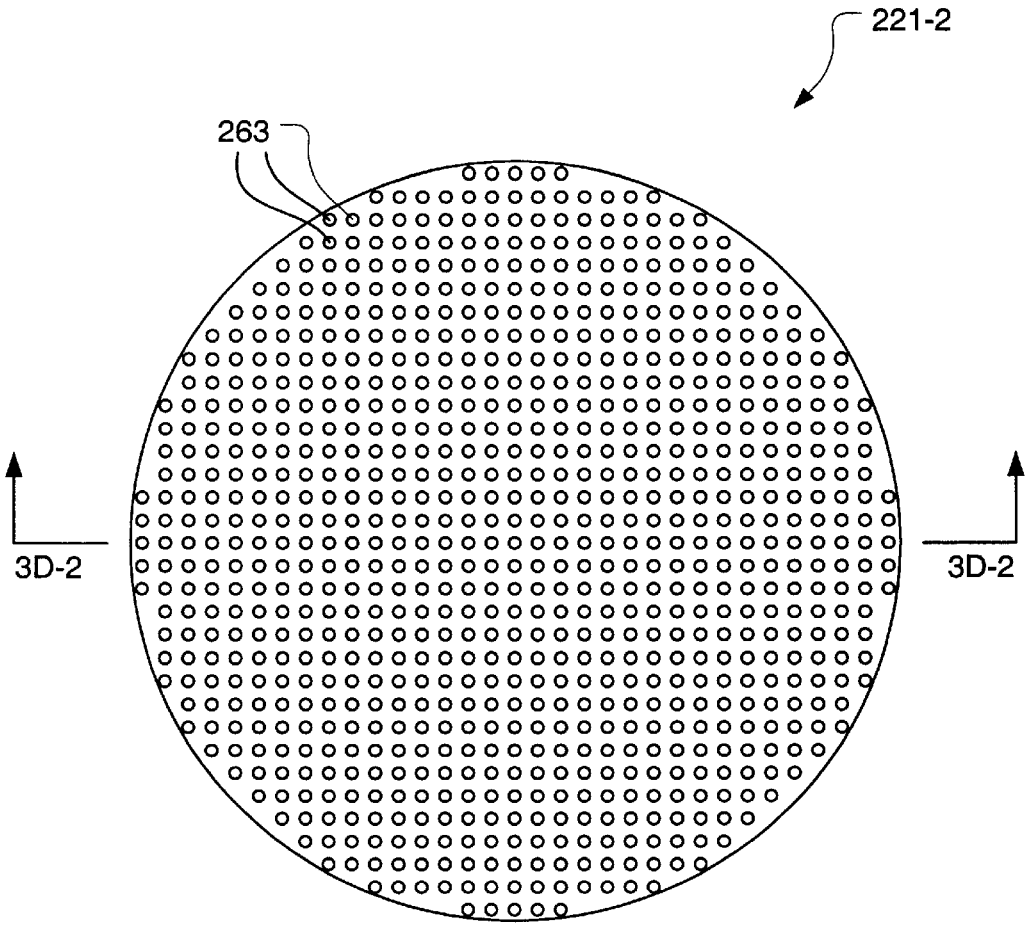
Figures 2, 3D:
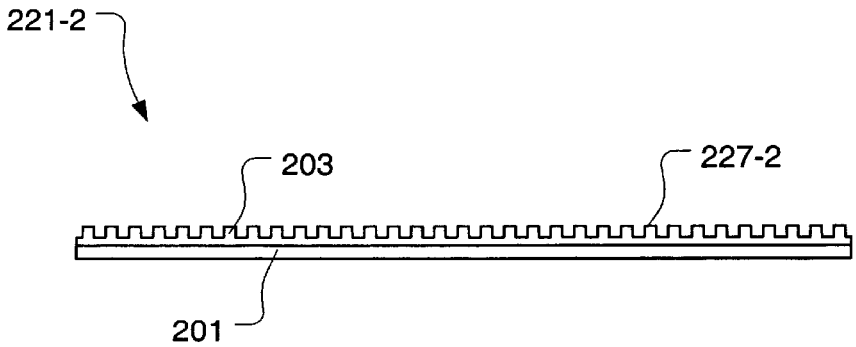

FIGS. 3D-1 and 3D-2 are illustrations showing a top view and cross-sectional view, respectively, of a planarization media 221-2 having a plurality of pillars 263 defined within the abrasive film 203 overlying the substrate 201, in accordance with one embodiment of the present invention. Each of the plurality of pillars 263 has an upper planar surface 227-2 defined at a substantially identical height above a surface of the substrate 201. In the exemplary embodiment of FIGS. 3D-1 and 3D-2, each of the plurality of pillars 263 has a cylindrical configuration. Those skilled in the art will recognize that pillars 263 may have other suitable configurations, e.g., a polygonal configuration.

Figure 4:
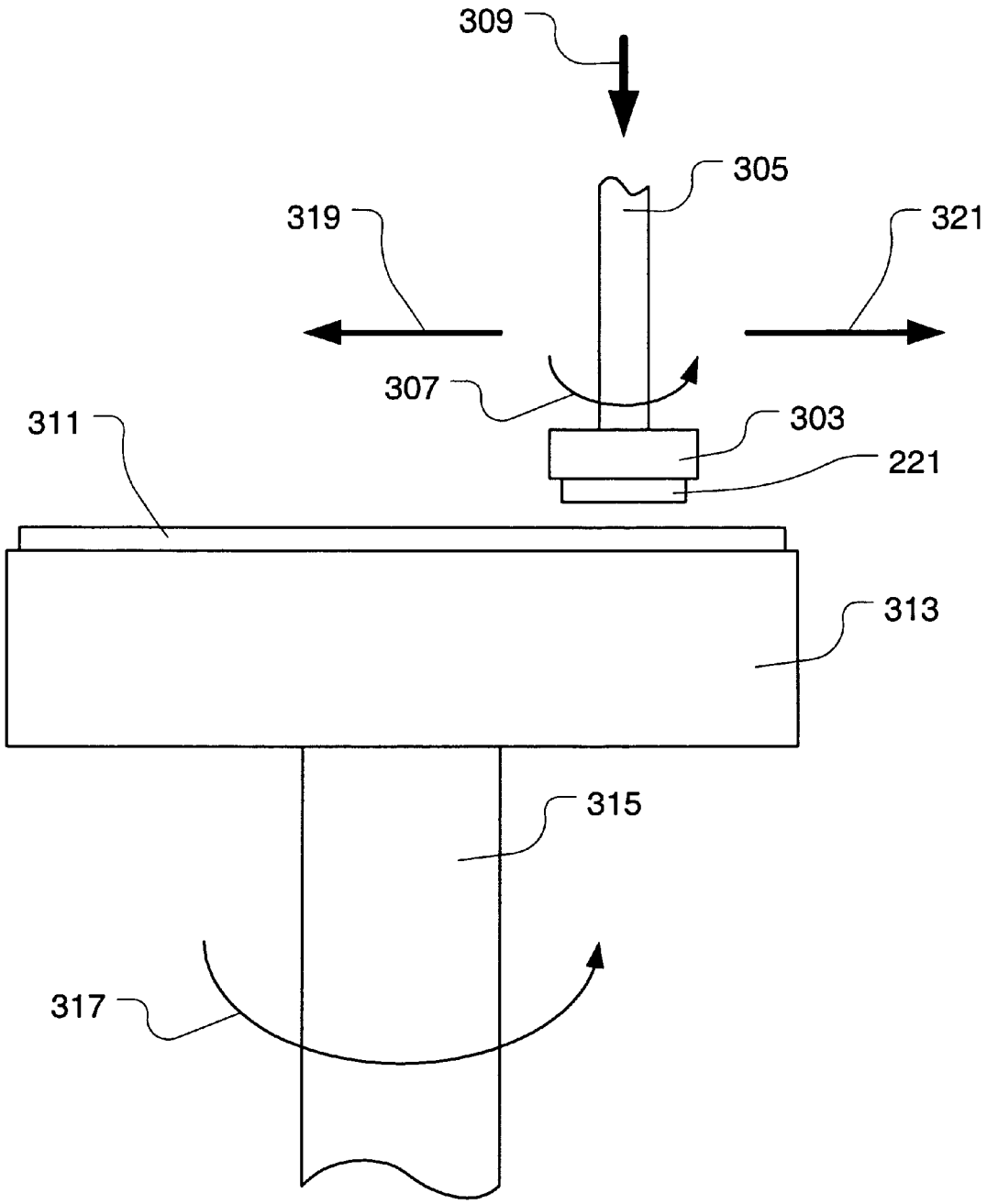
FIG. 4 is an illustration showing a CMP apparatus implementing a planarization media, in accordance with one embodiment of the present invention.

FIG. 4 is an illustration showing a CMP apparatus implementing the planarization media 221, in accordance with one embodiment of the present invention. The CMP apparatus includes a wafer support structure having a wafer holder 313 attached to a top end of a first spindle 315. The wafer holder 313 is capable of securely and safely holding a wafer 311 during a CMP operation. In one embodiment, the first spindle 315 is capable of rotating in a direction 317. In other embodiments, the first spindle 315 can be rotated in an opposite direction or in both directions. Thus, the wafer support structure is capable of rotating the wafer 311 during the CMP process. The CMP apparatus further includes a planarization media holder 303 attached to a bottom end of a second spindle 305. The planarization media holder 303 is capable of rigidly holding the planarization media 221 during the CMP operation. In one embodiment, the second spindle 305 is capable of rotating in a direction 307 while applying a downward force indicated by arrow 309. In other embodiments, the second spindle 305 can be rotated in an opposite direction or in both directions. The downward force (see arrow 309) is transmitted through the planarization media holder 303 to the planarization media 221. During the CMP process, the downward force is carefully controlled to apply a patterned abrasive film of the planarization media 221 to a surface of the wafer 311. The second spindle 305 is also capable of traversing linearly across the wafer holder 313 as indicated by directions 319 and 321. In this manner, the planarization media 221 can be moved linearly across the wafer 311 during the CMP process.

In the exemplary embodiment of FIG. 4, the planarization media 221 is shown to have a diameter smaller than a diameter of the wafer 311. However, in other embodiments, the diameter of the planarization media can be larger or smaller to accommodate different CMP process requirements. In one embodiment, the diameter of the planarization media 221 is approximately the same as the diameter of the wafer 311. When the diameter of the planarization media 221 is smaller than the diameter of the wafer 311, the CMP process can be performed to focus more on a smaller surface area of the wafer 311. For example, the diameter of the planarization media 221 can be just large enough to cover a single die (approximately 20 mm) contained on the wafer 311. As the diameter of the planarization media 221 is decreased with respect to the diameter of the wafer 311, the rotational speed of the planarization media 221 can be increased with respect to the rotational speed of the wafer 311. For smaller planarization media diameters, rotational speeds of up to 10,000 RPM can be used. Additionally, for a given diameter of the planarization media 221, the planarization media holder 303 and the second spindle 305 are sized to ensure that the downward force 309 can be uniformly applied across a surface of the planarization media 221.

FIGS. 5A–5G illustrate a method for performing a CMP process, in accordance with one embodiment of the present invention. The method includes an operation 401 in which a planarization media is provided. As shown in FIG. 5A, the planarization media has the patterned abrasive film 203 overlying the substrate 201. In an operation 406 (see FIG. 5B), the planarization media is used to perform one or more CMP processes. In each CMP process, the planarization media is used to remove a material from a surface of a wafer as is well known to those skilled in then art. As the planarization media continues to be used, the patterned abrasive film 203 can wear away. In an operation 407 (see FIG. 5C), it is determined whether the patterned abrasive film 203 has reached a worn state, i.e., a state of unacceptable wear. The method continues with an operation 411 in which the planarization media is reclaimed. The reclaiming operation 411 includes operations 421, 423, and 425. In operation 421 (see FIG. 5D), a remaining abrasive film is removed from the substrate 201. In operation 423 (see FIG. 5E), a fresh abrasive film 203-1 is deposited over the substrate 201. In operation 425 (see FIG. 5F), the fresh abrasive film 203-1 is patterned. As shown in FIG. 5G, the method then proceeds with an operation 427 in which the reclaimed planarization media is used in further CMP processes. Reclaiming the planarization media in this manner allows a total consumable cost of the CMP process to be reduced.

Figure 6:
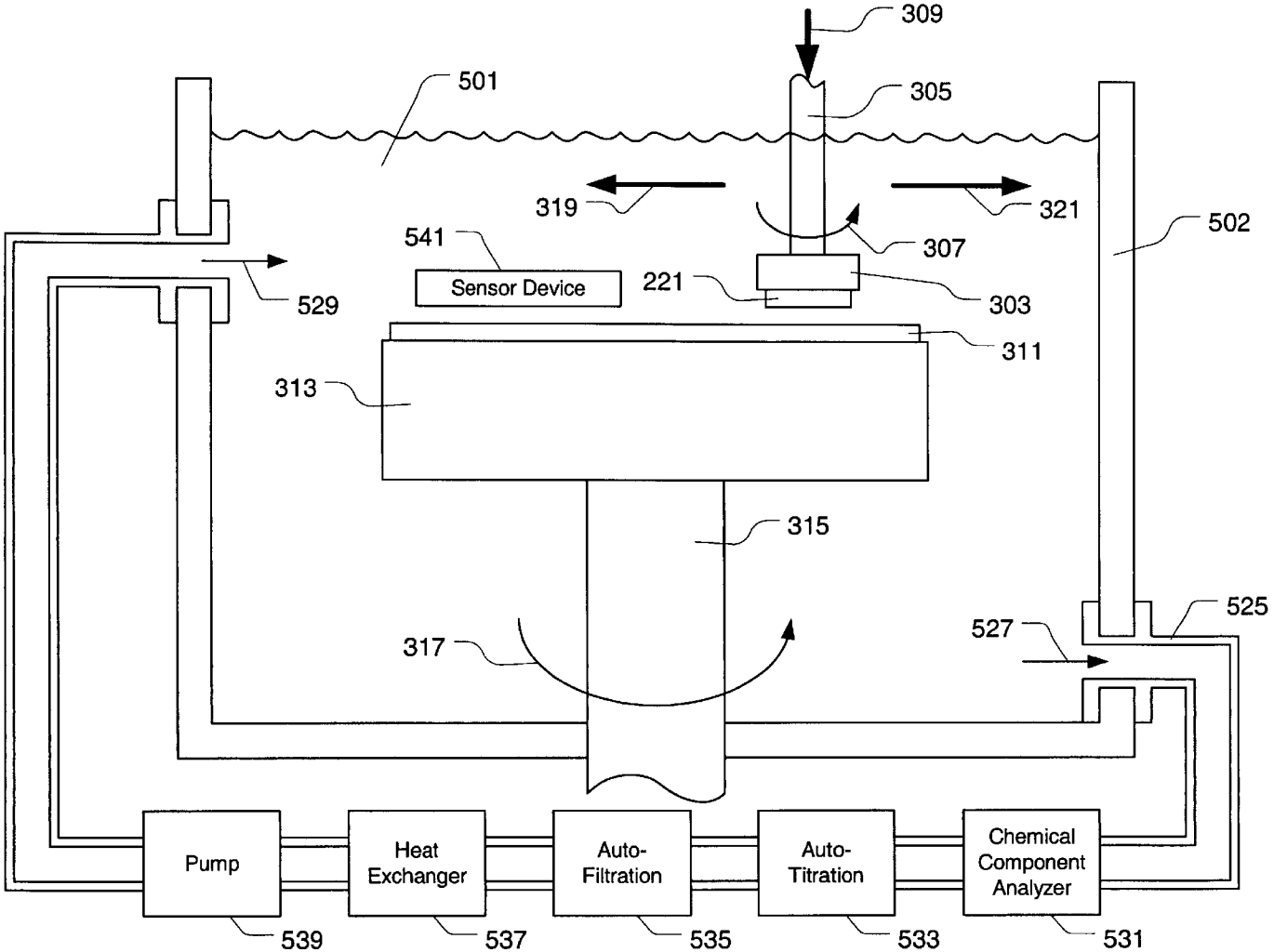
FIG. 6 is an illustration showing a CMP apparatus implementing a planarization media in a bath of an aqueous solution, in accordance with one embodiment of the present invention.

FIG. 6 is an illustration showing a CMP apparatus implementing the planarization media 221 in a bath of an aqueous solution 501, in accordance with one embodiment of the present invention. The CMP apparatus includes a tank 502 capable of holding the bath of the aqueous solution 501. In one embodiment, the tank 502 can be open to the atmosphere. In another embodiment, the tank 502 can be an enclosed tank capable of accommodating a negative or a positive internal pressure. The enclosed tank internal pressure can be adjusted within a range extending from about 5 mm Hg to about 1035 mm Hg. If required, the enclosed tank can also incorporate a gas blanket (e.g., $N_2$) over the aqueous solution 501.

The aqueous solution 501 can be essentially the same as a conventional CMP slurry excluding an abrasive component. In general, for performing a CMP process to remove non-metallic materials (e.g., $SiO_2$), an alkaline aqueous solution can be used. Examples of suitable alkaline aqueous solutions include KOH, $NH_4OH$, and CsOH. In general, for performing a CMP process to remove metallic materials, an acidic aqueous solution can be used. The acidic aqueous solution can contain a complexing agent to complex a metal removed from a wafer surface into an ionic form. The acidic aqueous solution can also contain one or more of an oxidizing agent, a film formation agent, and a surfactant. In one embodiment, the aqueous solution 501 is formulated to be synergistic with the planarization media 221 such that a desired charge interface (i.e., zeta-potential) is established between the planarization media 221 and the wafer surface. The desired charge interface can assist in preferentially removing one material relative to another material from the wafer surface.

Still referring to FIG. 6, a wafer support structure having the wafer holder 313 attached to the top end of the first spindle 315 is disposed within the tank 502 at a submerged location within the aqueous solution 501. The wafer holder 313 is capable of securely and safely holding the wafer 311 during a CMP process. In one embodiment, the first spindle 315 is capable of rotating in the direction 317. In other embodiments, the first spindle 315 can be rotated in an opposite direction or in both directions. Thus, the wafer support structure is capable of rotating the wafer 311 during the CMP process. With the wafer 311 submerged within the aqueous solution 501, an isothermal environment is created with respect to the wafer 311. Therefore, temperature variations across a surface of the wafer 311 can be significantly reduced during the CMP process. Those skilled in the art will recognize that conventional wafer handling techniques can be used with the CMP apparatus to move the wafer 311 into or out of the tank 502. If desired, the CMP apparatus can be configured to process more than one wafer 311 at a time.

The exemplary CMP apparatus shown in FIG. 6 further includes the planarization media holder 303 attached to the bottom end of the second spindle 305. The planarization media holder 303 is capable of rigidly holding the planarization media 221 during the CMP process. In one embodiment, the second spindle 305 is capable of rotating in the direction 307 while applying a downward force 309. In other embodiments, the second spindle 305 can be rotated in an opposite direction or in both directions. The downward force 309 is transmitted through the planarization media holder 303 to the planarization media 221. During the CMP process, the downward force 309 is carefully controlled to apply a patterned abrasive film of the planarization media 221 to the surface of the wafer 311 at the submerged location within the aqueous solution 501. The second spindle 305 is also capable of traversing linearly across the wafer holder 313 as indicated by directions 321 and 319. In this manner, the planarization media 221 can be moved linearly across the wafer 311 during the CMP process.

As shown in FIG. 6, the CMP apparatus also includes a recirculation line 525 for flowing the aqueous solution 501 from the tank 502 through an input end as indicated by an arrow 527, through a set of reconditioning and recirculating components, and back to the tank 502 through an output end as indicated by an arrow 529. The input and output ends of the recirculation line 525 can be positioned to penetrate the tank 502 at any location that provides adequate flow of the aqueous solution 501. In one embodiment, the input and output ends of the recirculation line 525 are positioned to cause a corresponding flow of aqueous solution 501 within the tank 502 to prevent stagnant regions of aqueous solution 501 from developing within the tank 502. In alternative embodiments, the CMP apparatus can include one or more recirculation lines. In one embodiment, the additional recirculation lines can have a dedicated set of reconditioning and recirculating components. In another embodiment, a number of the recirculation lines can share a common set of reconditioning and recirculating components. The reconditioning and recirculating components can include one or more of a chemical component analyzer (CCA) 531, an auto-titration component 533, an auto-filtration component 535, a heat exchanger 537, and a pump 539. The recirculation and reconditioning components can be used to monitor and control a chemistry of the aqueous solution 501. Thus, the recirculation and reconditioning components can be used as part of a closed loop feedback control system to ensure that the aqueous solution 501 remains ideally suited for the CMP process. The recirculation and reconditioning components can also be used to monitor reaction kinetics so that various chemical components can be replenished as they are consumed during the CMP process. Monitoring of the reaction kinetics can also provide input for determining an appropriate flow rate through the recirculation line 525. Through recirculation and reconditioning, the aqueous solution 501 is used in a more efficient manner than the manner in which conventional slurries are used in conventional CMP systems.

The CCA 531 can be used to determine a composition of the aqueous solution 501 either at a specific time or continuously during the CMP process. The CCA 531 is capable of identifying additives and associated molar weights within the aqueous solution 501. Adjustments in the composition of the aqueous solution 501 can be made either manually or automatically in response to the CCA 531 determination. The CCA 531 can also be used to detect removal of a target material from the surface of the wafer 311. In this manner, the CCA 531 can be used to detect an endpoint of the CMP process. For example, in a CMP process where a Cu layer is being removed from an underlying TaN layer, the CCA 531 can be used to detect the presence of Ta species (the target material) within the aqueous solution 501. The detection of Ta species by the CCA 531 indicates that the Cu layer has been completely removed and the CMP process endpoint has been reached.

The auto-titration component 533 can be used to ensure that an oxidizer concentration is maintained within the aqueous solution 501. For example, in a CMP process to remove a metal from the surface of the wafer 311, an appropriate concentration of hydrogen peroxide may be required as an oxidizer and monitored by the auto-titration component 533. Furthermore, the auto-filtration component 535 can be used to filter byproducts from the CMP process out of the aqueous solution 501. The by-products may include materials removed from the surface of the wafer 311, used chemical reactants, or used additives. Additionally, the heat exchanger 537 can be used to control a temperature of the aqueous solution 501 within a range extending from about 10° C. to about 85 C.

With continuing reference to FIG. 6, the CMP apparatus can further include a number of sensor devices 541 for monitoring a condition of the wafer 311 during the CMP process. The sensor devices 541 can provide one or more of the following capabilities: measuring a film thickness on the surface of the wafer 311; measuring an optical reflection from the surface of the wafer 311; or measuring an eddy current on the surface of the wafer 311. Each of these capabilities can be used to detect when a particular plane or material of the wafer 311 becomes exposed during the CMP process. By detecting the exposure of a particular plane or material of the wafer 311, the progression of the CMP process can be tracked.

The features of the planarization media of the present invention (i.e., abrasive material, topography, surface roughness, etc.) in combination with the chemistry of the aqueous solution provide increased flexibility and control with respect to preferentially removing a particular material from the surface of the wafer. The ability to remove one material from the surface of the wafer in preference to another material is termed "selectivity." The planarization media and the CMP apparatus of the present invention allow a selectivity of up to 1,000-to-1 to be achieved. Thus, a large process window can be created in which one material can be removed from the surface of the wafer at a rate up to 1,000 times faster than another material. With a sufficiently high selectivity, the wafer can be overpolished in the CMP process to ensure that one material is completely removed without simultaneously and detrimentally removing another material. For example, consider a CMP process to remove excess Cu from an underlying layer of the wafer. The planarization media and the aqueous solution chemistry can be formulated to provide a 1,000-to-1 selectivity of Cu versus the underlying layer. Thus, a large process window exists in which Cu can be removed at a rate of 0.1 micron/min while the underlying layer is only removed at a rate of 0.0001 micron/min. To ensure complete removal of the Cu, the CMP process can continue for an extended period of time without removing an unacceptable amount of the underlying layer. Hence, the planarization media and CMP apparatus of the present invention provide a self-stopping CMP process. Accordingly, nonuniformities in CMP process results can be decreased and more carefully controlled through use of the planarization media and CMP apparatus of the present invention.

The advantages of the present invention are numerous. Most notably, the CMP apparatus and the method of the present invention enable superior uniform planarization results to be achieved. The CMP apparatus provides an isothermal environment that significantly reduces temperature variations across the wafer surface and significantly reduces the shear forces exerted onto the wafer surface during the CMP process.

When an engineered planarization media, i.e., a planarization media having an abrasive film, is used, the improved surface property control of the planarization media enables a superior wafer surface planarity to be achieved. The CMP apparatus in conjunction with the engineered planarization media enables damage-free planarization processes involving relatively fragile wafer materials such as copper and low-k dielectric material. Planarization and film removal can now be performed more safely, i.e., without damaging the fragile wafer materials, through the use of the isothermal CMP apparatus and the engineered planarization media, which when combined provide more uniform and controlled friction distribution.

In addition, the CMP apparatus and the method of the present invention increase selectivity and thereby allow a CMP process to be self-stopping. In addition, flexibility in sizing of the planarization media can allow the CMP process to focus on a specific portion of the wafer. The CMP apparatus and the method of the present invention also offer economic advantages. For example, through recirculation and reconditioning, the aqueous solution in the CMP apparatus of the present invention is used more efficiently than conventional slurries are used in conventional CMP systems. Also, the engineered planarization media can be reclaimed to reduce the total consumable cost of the CMP process.

In summary, the present invention provides a chemical mechanical planarization (CMP) apparatus that includes a bath of an aqueous solution. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A chemical mechanical planarization apparatus, comprising:

a bath of an aqueous solution;

a first holder configured to support a wafer, the first holder being disposed within the bath;

a first spindle configured to rotate the first holder;

a second holder disposed above the first holder;

a planarization media supported by the second holder, the planarization media being disposed within the bath, the planarization media being oriented to face the surface of the first holder on which the wafer is to be supported, and the planarization media including a substrate and an abrasive film overlying the substrate, the abrasive film having a topography defined by a plurality of upper planar surfaces that is separated by a plurality of recesses; and a second spindle configured to rotate the second holder.

2. A chemical mechanical planarization apparatus as recited in claim 1, further comprising a system for recirculating and reconditioning the aqueous solution.

3. A chemical mechanical planarization apparatus as recited in claim 2, wherein the system for recirculating and reconditioning the aqueous solution comprises:

a chemical component analyzer;

an auto-titration device;

an auto-filtration device;

a heat exchanger; and a pump.

4. A chemical mechanical planarization apparatus as recited in claim 3, wherein the chemical component analyzer is configured to determine a composition of the aqueous solution.

5. A chemical mechanical planarization apparatus as recited in claim 3, wherein the auto-titration device is configured to maintain an oxidizer concentration in the aqueous solution.

6. A chemical mechanical planarization apparatus as recited in claim 3, wherein the auto-filtration device is configured to filter by-product materials from the aqueous solution, the by-product materials being selected from the group consisting of materials removed from the wafer, used chemical reactants, and used chemical additives.

7. A chemical mechanical planarization apparatus as recited in claim 3, wherein the heat exchanger is configured to maintain a temperature of the aqueous solution within a range extending from about 10° C. to about 85° C.

8. A chemical mechanical planarization apparatus as recited in claim 1, further comprising a device for monitoring a condition of the wafer to be supported by the first holder, the device being capable of measuring a wafer surface characteristic parameter selected from the group consisting of a film thickness, an optical reflection, and an eddy current.

9. A chemical mechanical planarization apparatus as recited in claim 1, wherein the planarization media is a pad comprising polyurethane.

10. A chemical mechanical planarization apparatus as recited in claim 1, wherein each of the plurality of upper planar surfaces has a root mean square surface roughness within a range extending from about 0.002 micron to about 0.1 micron.

11. A chemical mechanical planarization apparatus as recited in claim 10, wherein each of the plurality of recesses has a width within a range extending from about 1 micron to about 1,000 microns, and each of the plurality of recesses has a depth within a range extending from about 10 microns to about 500 microns.

12. A chemical mechanical planarization apparatus, comprising:

a bath of an aqueous solution;

a wafer support structure disposed within the bath;

a holder disposed within the bath above the wafer support structure;

a planarization media supported by the holder, the planarization media being oriented to face the surface of the wafer support structure on which a wafer is to be supported, the planarization media including a substrate and an abrasive film overlying the substrate, the abrasive film having a topography defined by a plurality of upper planar surfaces that is separated by a plurality of recesses; and a system for recirculating and reconditioning the aqueous solution.

13. A chemical mechanical planarization apparatus as recited in claim 12, further comprising a device for monitoring a condition of the wafer to be supported by the wafer support structure, the device being capable of measuring a wafer surface characteristic parameter selected from the group consisting of a film thickness, an optical reflection, and an eddy current.

14. A chemical mechanical planarization apparatus as recited in claim 12, wherein the wafer support structure and the holder are each configured to be rotated.

15. A chemical mechanical planarization apparatus as recited in claim 12, wherein the system for recirculating and reconditioning the aqueous solution comprises:

a chemical component analyzer configured to determine a composition of the aqueous solution;

an auto-titration device configured to maintain an oxidizer concentration in the aqueous solution;

an auto-filtration device configured to filter by-product materials from the aqueous solution, wherein by-product materials include materials removed from the wafer, used chemical reactants, and used chemical additives;

a heat exchanger configured to maintain a temperature of the aqueous solution within a range extending from about 10° C. to about 85° C.; and a pump.

16. A chemical mechanical planarization apparatus as recited in claim 12, wherein the planarization media is a pad comprising polyurethane.

17. A chemical mechanical planarization apparatus as recited in claim 12, wherein each of the plurality of upper planar surfaces has a root mean square surface roughness within a range extending from about 0.002 micron to about 0.1 micron, each of the plurality of recesses has a width within a range extending from about 1 micron to about 1,000 microns, and each of the plurality of recesses has a depth within a range extending from about 10 microns to about 500 microns.

18. A chemical mechanical planarization apparatus as recited in claim 17, wherein the plurality of upper planar surfaces occupies a percentage of a total surface area of the substrate, the percentage of the total surface area being within a range extending from about 10% to about 85%.

19. A chemical mechanical planarization apparatus as recited in claim 17, wherein the substrate comprises a material selected from a group consisting of silicon, quartz, ceramic materials, and plastics.

20. A chemical mechanical planarization apparatus as recited in claim 17, wherein the abrasive film comprises a material selected from a group consisting of $SiO_2$, $Si_3N_4$, $Al_2O_3$, SiC, CeO, and polysilicon.

21. A chemical mechanical planarization apparatus as recited in claim 17, wherein the abrasive film has a thickness within a range extending from about 0.1 micron to about 100 microns.

22. A chemical mechanical planarization apparatus as recited in claim 17, wherein the plurality of recesses is parallel to one another and each of the plurality of recesses traverses the substrate.

23. A chemical mechanical planarization apparatus as recited in claim 17, wherein the plurality of recesses includes a first plurality of parallel recesses traversing the substrate in a first direction and a second plurality of parallel recesses traversing the substrate in a second direction, the second direction being perpendicular to the first direction.

24. A chemical mechanical planarization apparatus as recited in claim 17, wherein each of the plurality of upper planar surfaces has a circular shape.

25. A chemical mechanical planarization apparatus as recited in claim 17, wherein each of the plurality of upper planar surfaces has a polygonal shape.

26. A method for performing a chemical mechanical planarization process, comprising:

immersing a wafer in a bath of an aqueous solution;

providing a planarization media, the planarization media being defined by a substrate and an abrasive film overlying the substrate, the abrasive film having a topography defined by a plurality of upper planar surfaces that is separated by a plurality of recesses;

bringing the planarization media in compliance with the wafer, the planarization media being oriented parallel to a plane of the surface of the wafer; and abrading a portion of the wafer in compliance with the planarization media.

27. A method for performing a chemical mechanical planarization process as recited in claim 26, wherein the abrading is effected by rotating the planarization media in compliance with the wafer while holding the wafer in a fixed position.

28. A method for performing a chemical mechanical planarization process as recited in claim 26, wherein the abrading is effected by rotating the planarization media in compliance with the wafer while rotating the wafer in an opposite direction relative to the planarization media.

29. A method for performing a chemical mechanical planarization process as recited in claim 26, further comprising circulating the aqueous solution.

30. A method for performing a chemical mechanical planarization process as recited in claim 26, further comprising monitoring a composition of the aqueous solution.

31. A method for performing a chemical mechanical planarization process as recited in claim 30, further comprising ceasing the abrading of the wafer upon detection of a target material in the aqueous solution.

32. A method for performing a chemical mechanical planarization process as recited in claim 26, further comprising reconditioning the aqueous solution by adjusting a composition of the aqueous solution.

33. A method for performing a chemical mechanical planarization process as recited in claim 32, wherein the reconditioning is performed by adjusting an oxidizer concentration in the aqueous solution.

34. A method for performing a chemical mechanical planarization process as recited in claim 32, wherein the reconditioning is performed by filtering by-product materials from the aqueous solution, the by-product materials being selected from the group consisting of materials removed from the wafer, used chemical reactants, and used chemical additives.

35. A method for performing a chemical mechanical planarization process as recited in claim 32, wherein the reconditioning is performed by adjusting a temperature of the aqueous solution within a range extending from about 10° C. to about 85° C.

36. A method for performing a chemical mechanical planarization process as recited in claim 26, further comprising monitoring a condition of the wafer in compliance with the planarization media.

37. A method for performing a chemical mechanical planarization process as recited in claim 36, wherein the monitoring is performed by measuring a wafer surface characteristic parameter selected from the group consisting of a film thickness, an optical reflection, and an eddy current.

* * * * *